US006809274B2

(12) United States Patent
Takeuchi et al.

(10) Patent No.: US 6,809,274 B2
(45) Date of Patent: Oct. 26, 2004

(54) FOUR-DIRECTIONAL CONTROL SWITCH

(75) Inventors: Masatsugu Takeuchi, Okayama (JP); Hisashi Watanabe, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/644,734

(22) Filed: Aug. 21, 2003

(65) Prior Publication Data

US 2004/0084289 A1 May 6, 2004

(30) Foreign Application Priority Data

Sep. 12, 2002 (JP) ..... 2002-266737

(51) Int. Cl.[7] ..... H01H 25/04
(52) U.S. Cl. ..... 200/6 A; 200/4; 200/557
(58) Field of Search ..... 200/4, 6 A, 553, 200/557; 345/157, 161

(56) References Cited

U.S. PATENT DOCUMENTS 2,808,476 A * 10/1957 Elliott ..... 200/6 A
6,080,941 A * 6/2000 Yokobori ..... 200/6 A
6,162,999 A * 12/2000 Ishikawa et al. ..... 200/6 A
6,262,381 B1 * 7/2001 Kikuchi et al. ..... 200/6 A
6,399,904 B1 * 6/2002 Mimata ..... 200/6 A
6,593,909 B1 * 7/2003 Chou ..... 345/157
2001/0047926 A1 12/2001 Kozuma

FOREIGN PATENT DOCUMENTS

JP 2001-351478 12/2001

* cited by examiner

*Primary Examiner*—James R. Scott
(74) *Attorney, Agent, or Firm*—Wenderoth, Lind & Ponack, L.L.P.

(57) ABSTRACT

A flange section presses a tip of one of four elastic arms upon tilting of a controlling unit formed of a stick and the flange section. The pressed elastic arm operates one of individual-switches disposed at four corners of a switch case. Each elastic arm extends from each side of the quadrangular switch case to at least a middle point of a side, which is adjacent and parallel to the arm. Using this structure, a four-directional control switch, which can effectively use a space in an electronic apparatus, can be obtained.

10 Claims, 9 Drawing Sheets

FOUR-DIRECTIONAL CONTROL SWITCH

BACKGROUND OF THE INVENTION

1. Field of the Invention

The present invention relates to a four-directional control switch used for controlling various compact electronic apparatuses.

2. Background Art

FIG. 12 shows a sectional front view of a conventional four-directional control switch, and FIG. 13 shows a plan view of a switch case accommodating movable contacts. Central-fixed contact 3 (hereinafter referred to as "contact 3") is placed on a center of an inner bottom of quadrangular switch case 1 (hereinafter referred to as "case 1") whose top is open. Contact 3 is formed of common contact 2 and central contact 3A for a central switch. As shown in FIG. 13, four individual-fixed contacts 4A–4D (hereinafter referred to as "contacts 4A–4D") for peripheral switches are placed at four corners of the inner bottom of case 1, and respective leading terminals are protruded from an outer periphery of case 1. Besides, in FIG. 13, movable contact spring 5 (hereinafter referred to as "spring 5") made of an elastic thin metal plate is formed by coupling dome-shaped central movable contact 6 (hereinafter referred to as "contact 6") with individual-movable contacts 7A–7D (hereinafter referred to as "contacts 7A–7D") via coupling section 5A. Contact 6 corresponds to contact 3, and contacts 7A–7D respectively correspond to contacts 4A–4D. Spring 5 is accommodated in case 1 in a manner that contact 6 and contacts 7A–7D respectively face toward contact 3 and contacts 4A–4D. Operating unit 8 and stick 9 are disposed on spring 5. Operating unit 8 is formed of cylindrical section 8A and skirt section 8B at its lower part. Stick 9 is held independently and movably in a vertical direction through central hole 8C of operating unit 8. Four hemispherical protrusions 10A–10D (hereinafter referred to as "protrusions 10A–10D") of a bottom of skirt section 8B respectively come into contact with tops of contacts 7A–7D, where protrusions 10B and 10D are not shown in the drawings. Bottom section 9A of stick 9 comes into contact with a top of contact 6. Operating unit 8 is rockably held through central hole 11A of cover 11 covering the top of case 1.

For example, as shown by an arrow in a sectional front view of FIG. 14, the four-directional control switch is operated by tilting stick 9 in a direction of one of the four corners of case 1. Thus, operating unit 8 also rocks and tilts, so that protrusion 10A of the bottom of skirt section 8B, which has been tilted and moved downward, presses downward contact 7A corresponding to protrusion 10A. As a result, contact 7A is elastically inverted. Contact 7A comes into contact with contact 4A, thereby permitting conduction between certain leading terminals. When pressing-force against stick 9 in the tilted direction is removed, the four-directional control switch is returned to an original state shown in FIG. 12 by elastic restoring force of contact 7A. When stick 9 is tilted in the direction of another one of the four corners, the same operation is executed, thereby permitting conduction between certain leading terminals. Then, when pressing-force is removed, the four-directional control switch returns to the original state.

As shown by an arrow in a sectional front view of FIG. 15, when stick 9 is pressed in a vertical downward direction, only stick 9 moves straight and downward. Thus, bottom section 9A presses contact 6 downward and elastically inverts contact 6. Then, contact 6 comes into contact with central contact 3A of contact 3, thereby permitting conduction between certain leading terminals. When pressing-force against stick 9 in the downward direction is removed, the four-directional control switch is returned to the original state shown in FIG. 12 by elastic restoring force of contact 6.

The conventional four-directional control switch discussed above is disclosed in Japanese Patent Unexamined Publication No. 2001-351478.

The conventional four-directional control switch has individual-switches at the four corners of quadrangular case 1, so that case 1 can be downsized. However, in an electronic apparatus using the conventional switch, stick 9 is generally tilted in a direction of front, rear, right or left when operated. Therefore, when the conventional switch is mounted on the electronic apparatus, case 1 has to be mounted on the electronic apparatus at a 45° angle with respect to a side of a casing of the electronic apparatus. In a word, case 1 needs to be mounted at an angled. Thus, an area corresponding to a quadrangle whose one side corresponds to a diagonal line of case 1 is needed for a space in the casing of the electronic apparatus. As a result, the conventional switch cannot effectively use a space in the casing of the electronic apparatus and is disadvantageous for downsizing of the electronic apparatus.

SUMMARY OF THE INVENTION

A four-directional control switch presses one of four elastic arms, whose flange section has a stiffness characteristic, by tilting a controlling unit formed of a stick and a flange section. The pressed elastic arm operates one of individual-switches disposed at four corners of a switch case. Each elastic arm extends from each side of the switch case to at least a middle point of a side, which is adjacent and parallel to the arm.

DETAILED DESCRIPTION OF THE INVENTION

Figure 1:
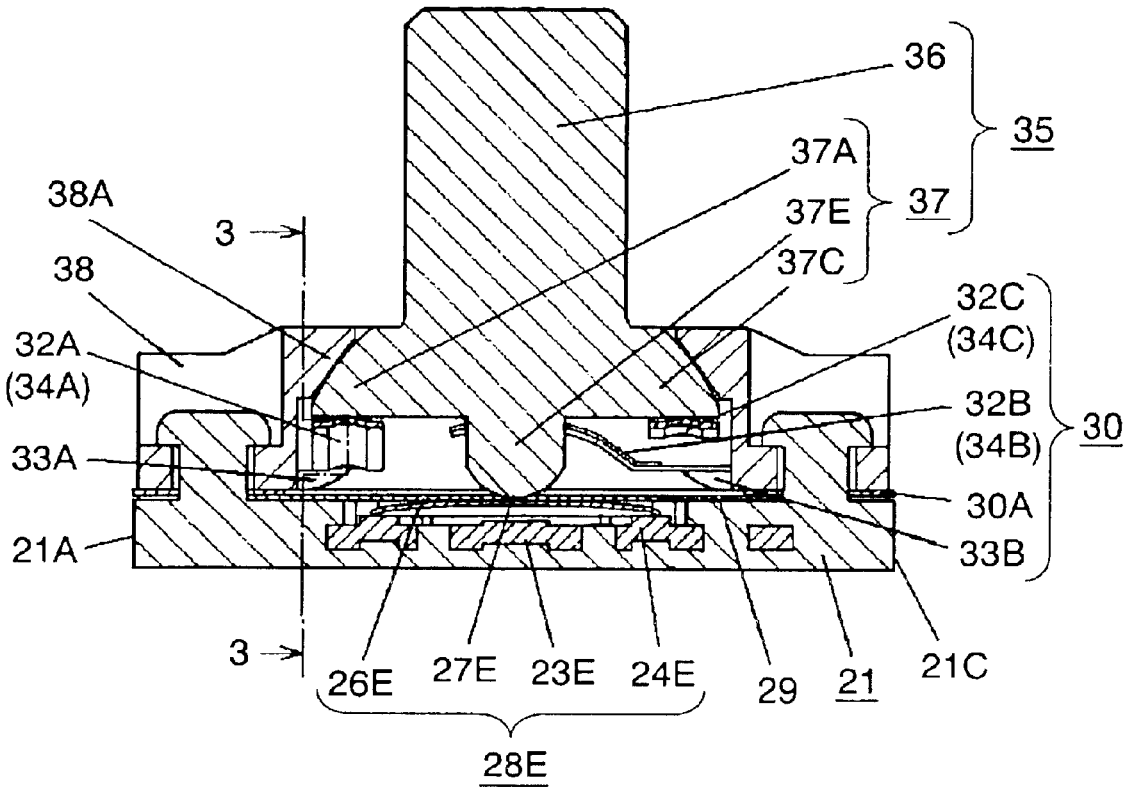
FIG. 1 is a sectional front view of a four-directional control switch in accordance with an exemplary embodiment of the present invention.
Figure 2:
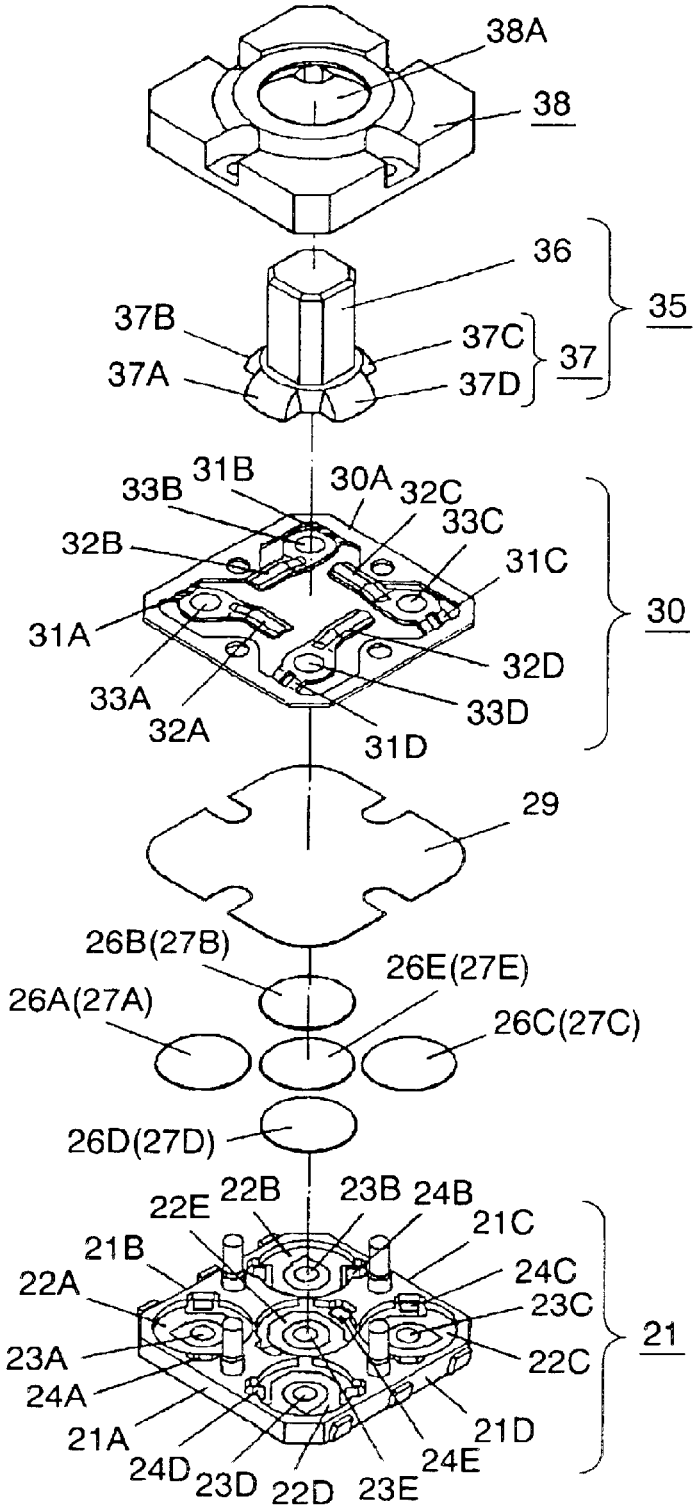
FIG. 2 is an exploded perspective view of the four-directional control switch.
Figure 3:
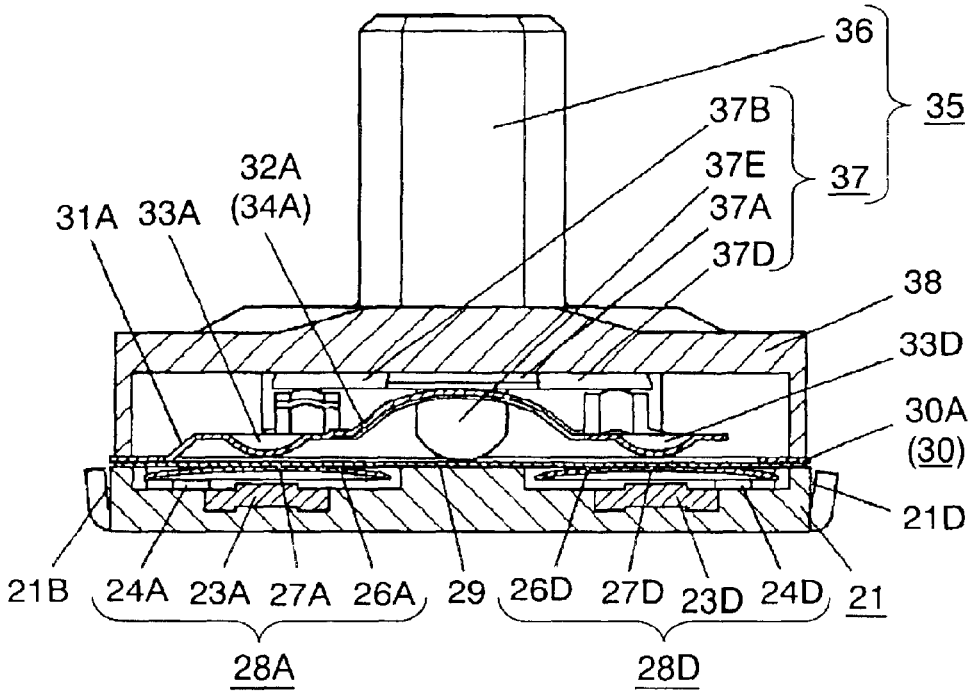
FIG. 3 is a sectional view of FIG. 1 taken along the line 3—3.
Figure 4:
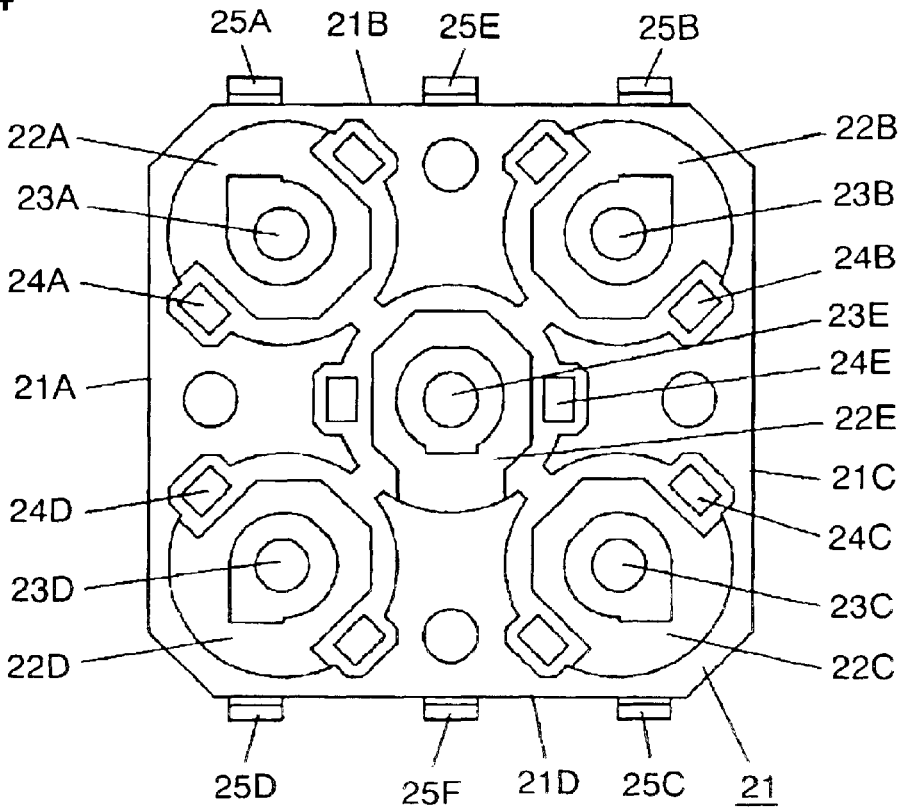
FIG. 4 is a plan view of a switch case of an essential part of the four-directional control switch.

FIG. 1 is a sectional front view of a four-directional control switch in accordance with an exemplary embodiment of the present invention. FIG. 2 is an exploded perspective view of the switch. FIG. 3 is a sectional view of FIG. 1 taken along the line 3—3. FIG. 4 is a plan view of a switch case of the switch.

Hollows 22A–22D are formed at four corners of an inner bottom of quadrangular switch case 21 (hereinafter referred to as "case 21") whose top is open, and hollow 22E is formed on a center of the inner bottom of case 21. Central contacts 23A–23D (hereinafter referred to as "contacts 23A–23D") and side contacts 24A–24D (hereinafter referred to as "contacts 24A–24D") are fixed at bottoms of hollows 22A–22D, where contacts 23A–23D respectively correspond to contacts 24A–24D. Central contact 23E (hereinafter referred to as "contact 23E") and side contact 24E (hereinafter referred to as "contact 24E") are fixed at a bottom of hollow 22E, where contact 23E and contact 24E make a pair.

In addition, as shown in FIG. 4, individual-leading terminals 25A–25E (hereinafter referred to as "terminals 25A–25E") and common leading terminal 25F (hereinafter referred to as "terminal 25F") are placed at case 21, and protruded from an outer periphery of case 21. Contacts 23A–23E are respectively coupled with terminals 25A–25E, and contacts 24A–24E are coupled with terminal 25F. Dome-shaped movable contacts 26A–26E (hereinafter referred to as "contacts 26A–26E") are made of elastic thin metal plates. Bottoms of outer peripheries of contacts 26A–26E are respectively disposed on contacts 24A–24E in hollows 22A–22E. Bottoms of top sections 27A–27E of contacts 24A–24E respectively confront contacts 23A–23E with a predetermined space. Four individual-switches 28A–28D (hereinafter referred to as "switches 28A–28D") and central switch 28E (hereinafter referred to as "switch 28E") are formed as discussed above, where switches 28B and 28C are not shown in the drawings. Switches 28A–28E individually work by pressing centers of upper sections of contacts 26A–26E.

Switches 28A–28E are constructed as discussed above, so that each switch can be downsized, stably operated with click-feeling and inexpensive.

Flexible insulating sheet 29 covers upper surfaces of hollows 22A–22E accommodating switches 28A–28E. This structure improves a dust proof characteristic and holds contacts 26A–26E at stable positions.

Figure 5:
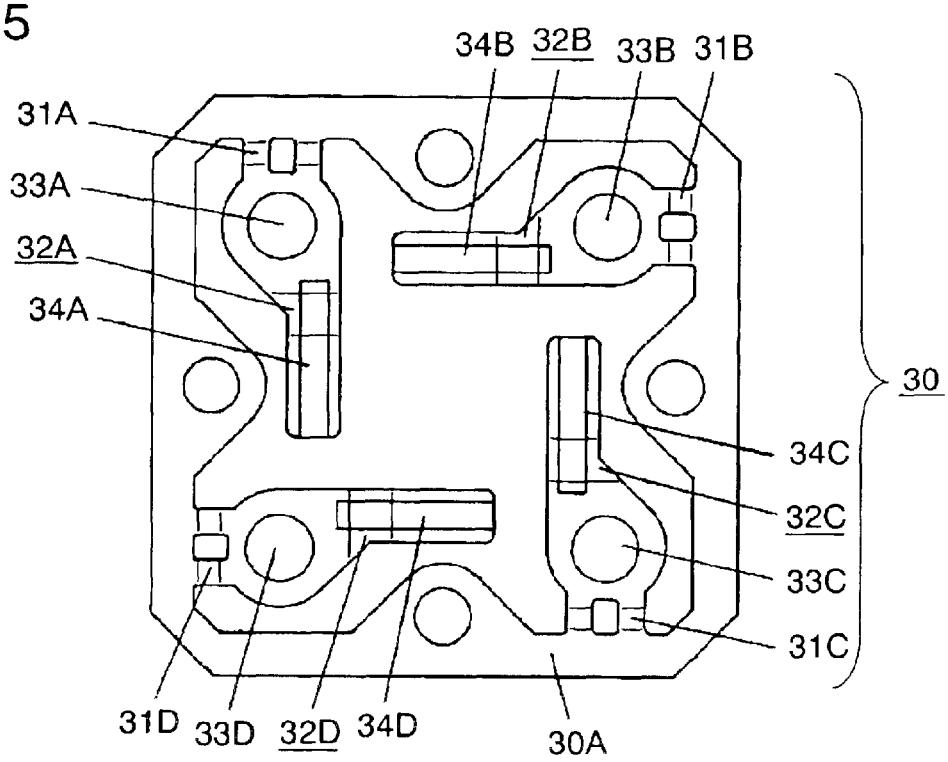
FIG. 5 is a plan view of an operating unit of an essential part of the four-directional control switch.
Figure 6:
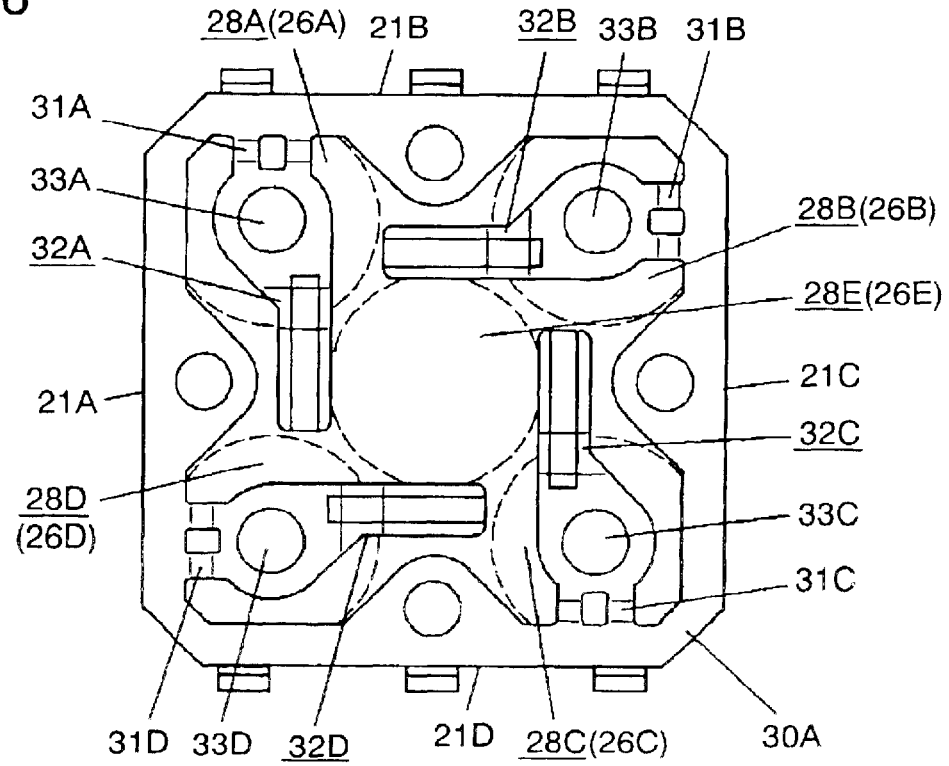
FIG. 6 is a plan view of the switch case, on which the operating unit of the essential part of the four-directional control switch is mounted.

Operating unit 30, which is formed by punching and bending an elastic thin metal plate, is mounted on an upper part of case 21. As shown in FIGS. 5–6, operating unit 30 includes elastic arms 32A–32D (hereinafter referred to as "arms 32A–32D") which extend from hinge sections 31A–31D having narrow widths. Each of hinge sections 31A–31D is placed at each side of frame 30A, which is the same size as a quadrilateral formed by four outer periphery walls 21A–21D of case 21. Each of arms 32A–32D extends from one side of case 21 to at least a middle point of another side, which is adjacent and parallel to the arm, through above a center of each of switches 28A–28E. As shown in FIG. 3, arms 32A–32D respectively have pressing sections 33A–33D, which confront top sections 27A–27D of contacts 26A–26D via insulating sheet 29 with a predetermined space, at their middle sections. Ribs 34A–34D are formed at arms 32A–32D for reinforcing in a manner such that each whole arm has enough stiffness.

As discussed above, pressing sections 33A–33D are respectively formed at arms 32A–32D, whereby switches 28A–28D positively work.

Operating unit 30 is formed in one piece, so that positional deviation of arms 32A–32D or pressing sections 33A–33D formed thereon is reduced.

Controlling unit 35 made of a resin is formed of stick 36 for operating the four-directional control switch and flange section 37 formed in one piece thereunder. Protrusion 37E at a center of a bottom of flange section 37 is contacted with and held by an upper surface of top section 27E of dome-shaped contact 26E of switch 28E via insulating sheet 29. Protrusions 37A–37D are formed at an outer periphery of flange section 37 and protruded forward four areas where upper surfaces of tips of arms 32A–32D are contacted.

Switches 28A–28E positively work due to the formation of protrusions 37A–37E, and controlling unit 35 is held and smoothly tilts due to the formation of protrusion 37E.

Cover 38 made of a resin covers an opening of an upper surface of case 21. A lower surface of central hole 38A of cover 38 holds a hemispheric upper surface of flange section 37 of controlling unit 35 tiltably and movably in a vertical direction, thereby causing stick 36 to protrude upward. Controlling unit 35 can smoothly tilt due to this structure. The hemispheric upper surface of flange section 37 does not rotate. Cover 38 is coupled with case 21 in a manner that frame 30A of operating unit 30 is sandwiched and fixed between a lower surface of outer peripheries of cover 38 and upper sections of outer periphery walls 21A–21D of case 21.

As discussed above, arms 32A–32D and pressing sections 33A–33D, which are formed thereon, are made in one piece as operating unit 30. Therefore, when controlling unit 35 and cover 38 are mounted, assembling becomes easy and positional deviation between pressing sections 33A–33D and switches 28A–28D is reduced. As a result, the four-directional control switch stably works.

The four-directional control switch is constructed as discussed above, and an operation thereof is described as follows.

The first operation is described hereinafter. In an ordinary state shown in FIG. 1, pressing-force is applied to stick 36 of controlling unit 35 in a direction of an arrow shown in a sectional front view of FIG. 7. In other words, stick 36 is tilted toward outer periphery wall 21A which is one of four sides of case 21. Then a contacted area between protrusion 37E and top section 27E of contact 26E of switch 28E works as a fulcrum, and the hemispheric upper surface of flange section 37 tilts along the lower surface of central hole 38A of cover 38 at the fulcrum. Protrusion 37A, which is formed at a side where flange section 37 tilts and moves downward, presses a tip, which comes into contact with protrusion 37A, of arm 32A downward.

Figure 7:
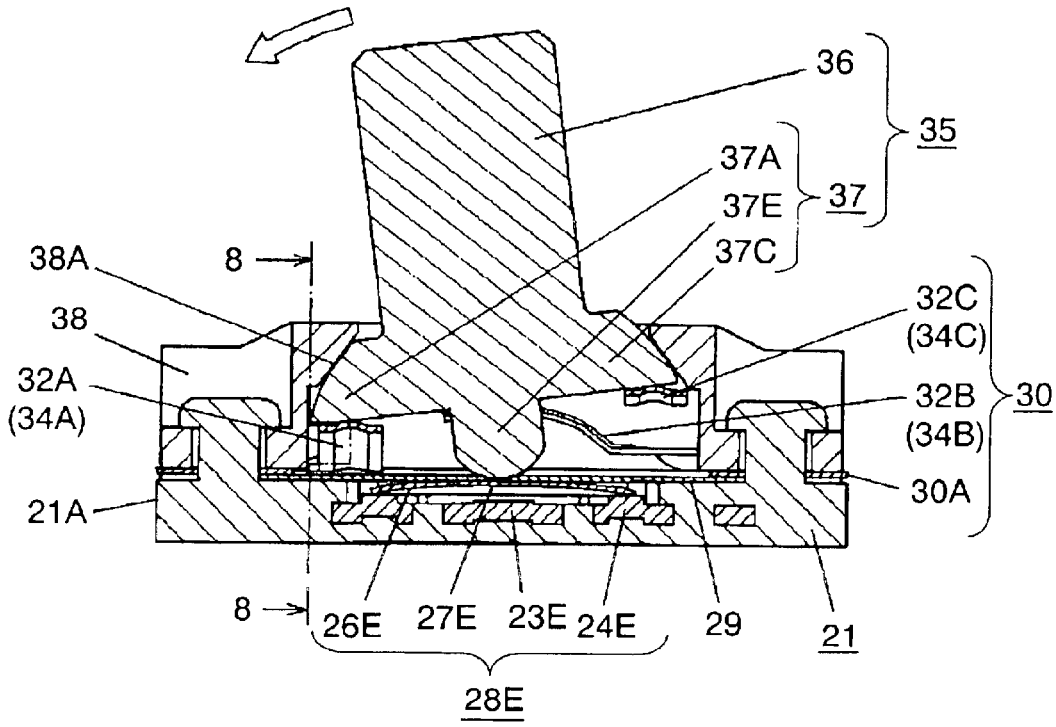
FIG. 7 is a sectional front view showing a state where a stick of the four-directional control switch is tilted for operation.
Figure 8:
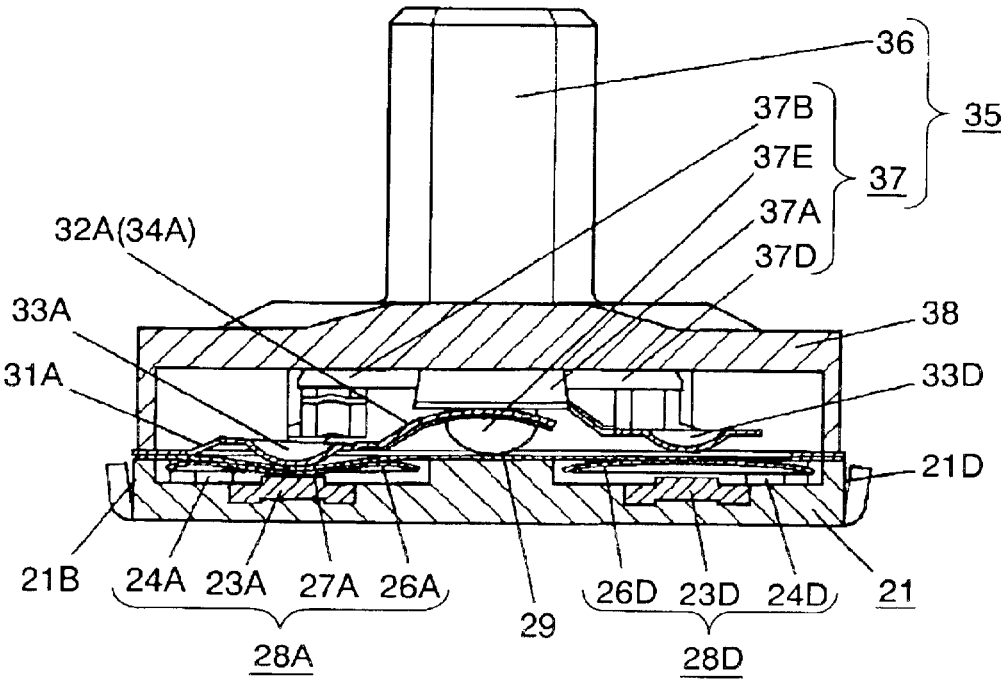
FIG. 8 is a sectional view of FIG. 7 taken along the line 8—8.

As shown in FIG. 8 which is a sectional view of FIG. 7 taken along the line 8—8, hinge section 31A, which is a root of arm 32A, works as a fulcrum and the whole arm 32A revolves at the fulcrum. Then pressing section 33A comes into contact with top section 27A of contact 26A of switch 28A, and presses contact 26A downward while bending insulating sheet 29.

Pressed contact 26A is elastically inverted and provides a click-feeling upon certain pressing-force and pressing stroke, so that a lower surface of top section 27A comes into contact with contact 23A. Thus, contact 23A and contact 24A electrically couple with each other, and switch 28A works. A signal is transmitted to a circuit of an electronic apparatus using this four-directional control switch via terminals 25A and 25F.

After that, when pressing-force against stick 36 of controlling unit 35 in the tilted direction is removed, arm 32A and contact 26A try to return to an original state due to their elastic restoring force. Therefore, a bottom of protrusion 37A of the outer periphery of flange section 37 is pressed back. Then, contact 23A and contact 24A are electrically separated from each other, so that switch 28A is placed in an OFF state and the four-directional control switch returns to the ordinary state shown in FIG. 1.

In the same manner as discussed, when stick 36 of controlling unit 35 is tilted toward one of other outer periphery walls 21B–21D, which is one of four sides of case 21, controlling unit 35 operates switch 28B, 28C or 28D in its tilted direction.

The tilted angle of stick 36 becomes larger than that of a conventional method by a ratio of a length between each of hinge sections 31A–31D and each tip of arms 32A–32D to a length between each of hinge sections 31A–31D and each of pressing sections 33A–33D. Therefore, even when an operator touches stick 36 by mistake, it is unlikely that the four-directional control switch will malfunction.

As mentioned above, ribs 34A–34D are formed at arms 32A–32D for reinforcing. Therefore, arms 32A–32D have enough stiffness. Using this structure, in the tilted operation of stick 36, when the tips of arms 32A–32D are pressed downward, pressing sections 33A–33D elastically and certainly invert respective contacts 26A–26D by certain pressing-force and pressing stroke.

As discussed above, in the four-directional control switch of this embodiment, each of switches 28A–28D is placed in an ON state by tilting stick 36 toward one side of case 21. Therefore, when the switch is mounted on the electronic apparatus, case 21 does not need to be angled with respect to a side of a casing of the electronic apparatus. As a result, the switch can effectively use a space in the casing of the electronic apparatus.

Figure 9:
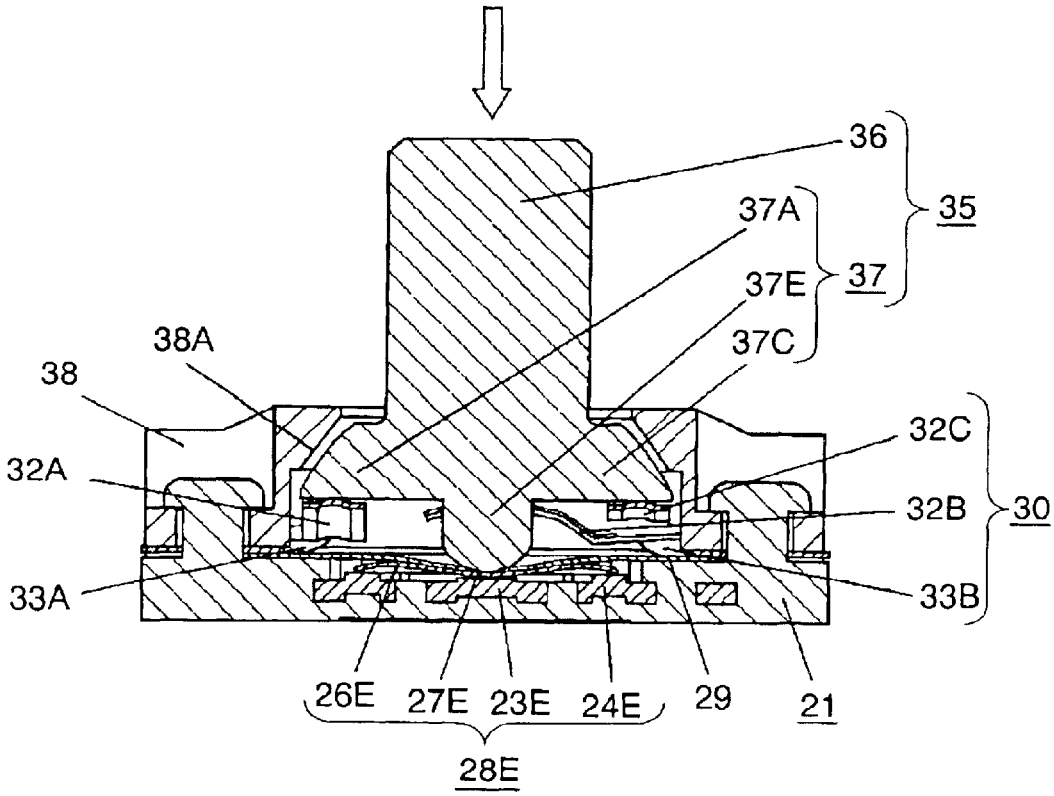
FIG. 9 is a sectional front view showing a state where the stick of the four-directional control switch is pressed for operation.

Next, the second operation is described hereinafter. In the ordinary state shown in FIG. 1, pressing-force is applied to stick 36 of controlling unit 35 in a vertical downward direction shown by an arrow of a sectional front view of FIG. 9. Whole controlling unit 35 moves downward, and the upper surface of flange section 37 of controlling unit 35 is separated from the lower surface of central hole 38A of cover 38. Protrusion 37E at the center of the bottom of flange section 37 presses top section 27E of contact 26E of switch 28E downward while bending insulating sheet 29.

Pressed contact 26E is elastically inverted and provides a click-feeling upon certain pressing-force and pressing stroke, so that a lower surface of top section 27E comes into contact with contact 23E. Thus, contact 23E and contact 24E electrically couple with each other, and switch 28E works. A signal is transmitted to the circuit of the electronic apparatus using this four-directional control switch via terminals 25E and 25F.

After that, when pressing-force against stick 36 of controlling unit 35 in the vertical downward direction is removed, contact 26E tries to return to the original state due to its elastic restoring force. Therefore, protrusion 37E at the center of the bottom of flange section 37 of controlling unit 35 is pressed back. Contact 23E and contact 24E are electrically separated from each other, so that switch 28E is placed in the OFF state and the four-directional control switch returns to the ordinary state shown in FIG. 1.

When pressing-force is applied to stick 36 of controlling unit 35 in the vertical downward direction, the upper surfaces of the tips of arms 32A–32D are also pressed downward by a length corresponding to the pressing stroke of contact 26E of switch 28E. Then hinge sections 31A–31D work as a fulcrum, and arms 32A–32D slightly revolve at the fulcrum. According to this revolving, pressing sections 33A–33D at a middle section of arms 32A–32D move downward not more than a half distance of movement of the tips of arms 32A–32D. As mentioned above, pressing sections 33A–33D are spaced from top sections 27A–27D of contacts 26A–26D at a predetermined distance. Therefore, when stick 36 is pressed, switches 28A–28D do not work.

As discussed above, in the four-directional control switch of this invention, certain input can be executed not only by tilting stick 36 of controlling unit 35 in four directions but also upon using switch 28E by pressing stick 36 in the vertical downward direction.

Besides the structure mentioned above, protrusion 37E at the center of the bottom of flange section 37 of controlling unit 35 can be held by an inner bottom of case 21 using only four switches 28A–28D, namely, without providing switch 28E. In this structure, if a hollow or the like corresponding to protrusion 37E is formed at the inner bottom of case 21 and protrusion 37E is rotatably held thereon, an operation for tilting becomes stable.

Figure 10:
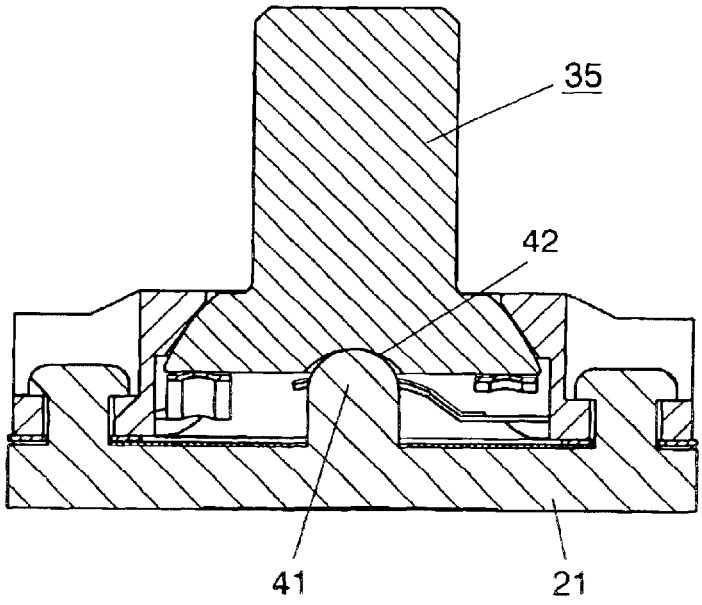
FIG. 10 is a sectional front view of another four-directional control switch in accordance with an exemplary embodiment of the present invention.
Figure 11:
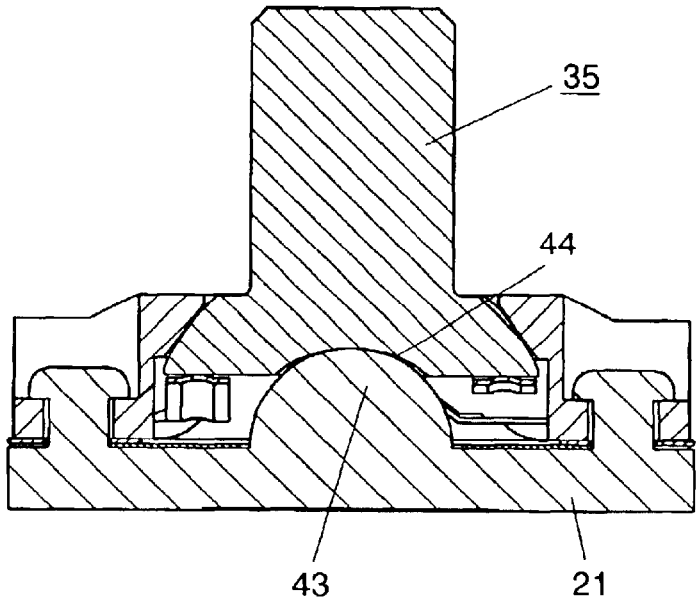
FIG. 11 is a sectional front view of still another four-directional control switch in accordance with an exemplary embodiment of the present invention.
Figure 12:
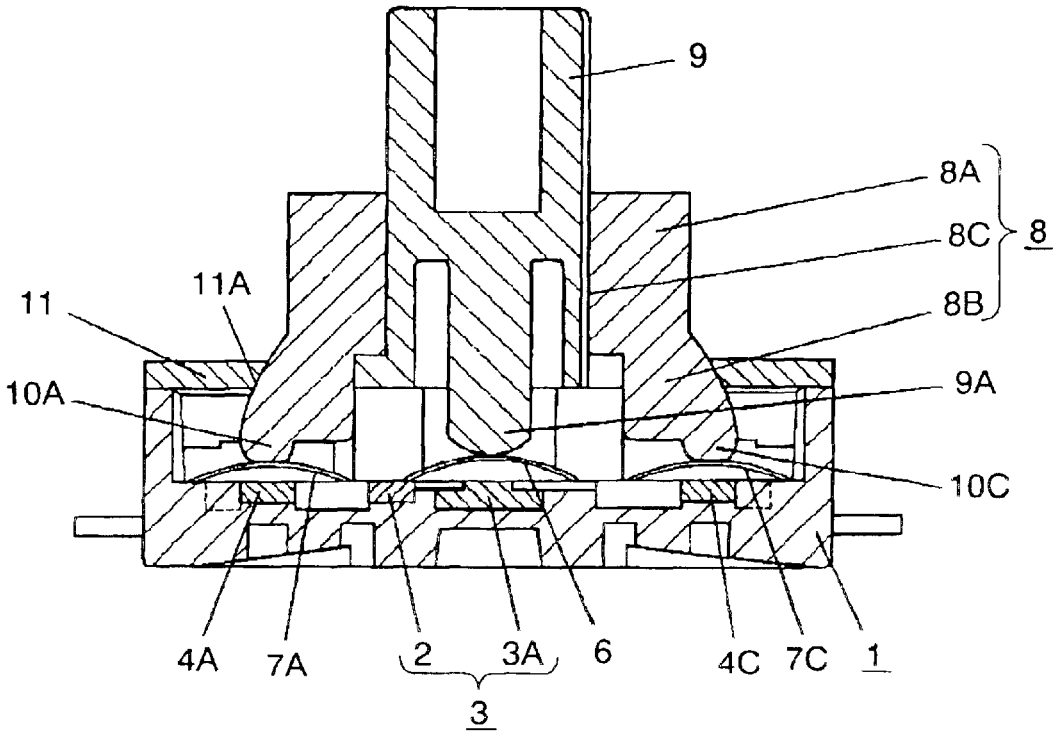
FIG. 12 PRIOR ART
FIG. 12 is a sectional front view of a conventional four-directional control switch.
Figure 13:
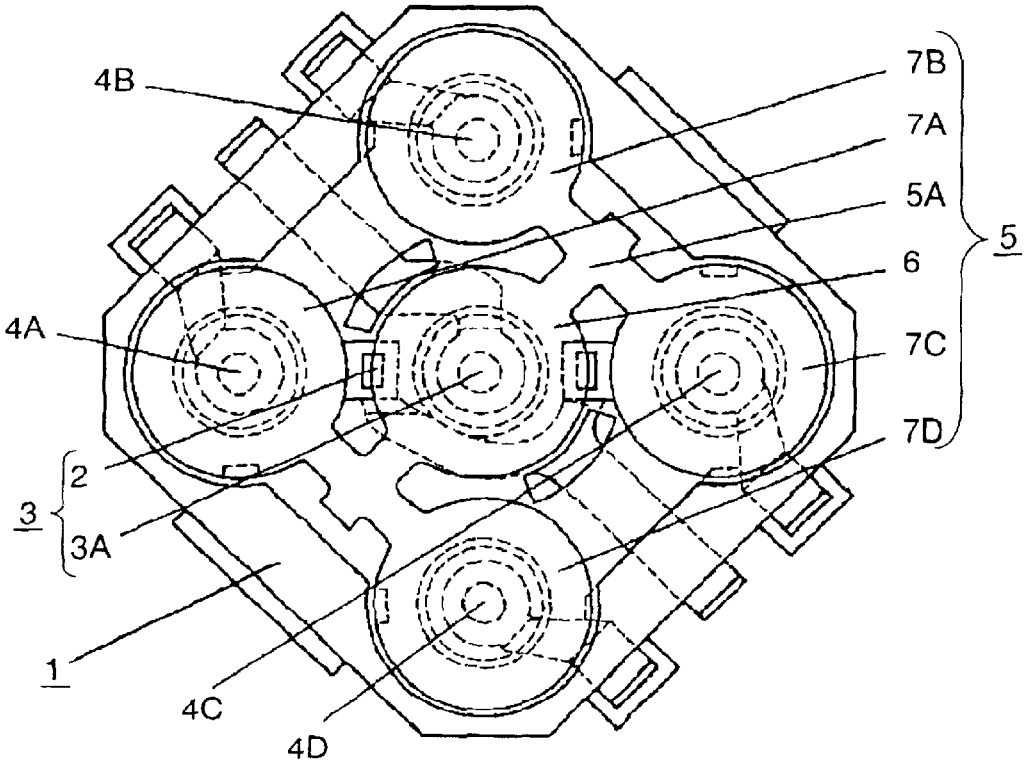
FIG. 13 PRIOR ART
FIG. 13 is a plan view of a switch case accommodating movable contacts of an essential part of the conventional four-directional control switch.
Figure 14:
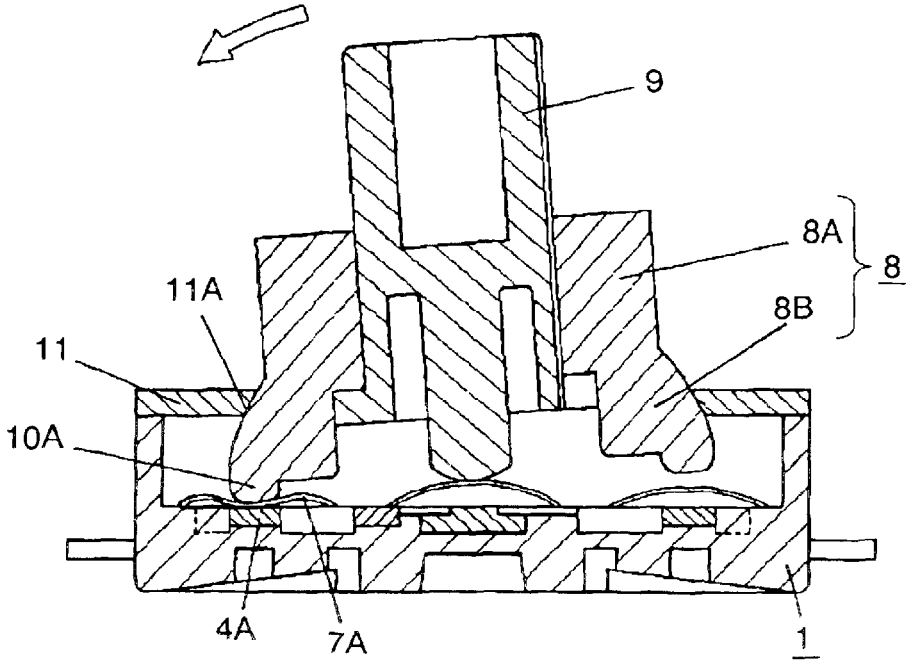
FIG. 14 PRIOR ART
FIG. 14 is a sectional front view showing a state where a stick of the conventional four-directional control switch is tilted for operation.
Figure 15:
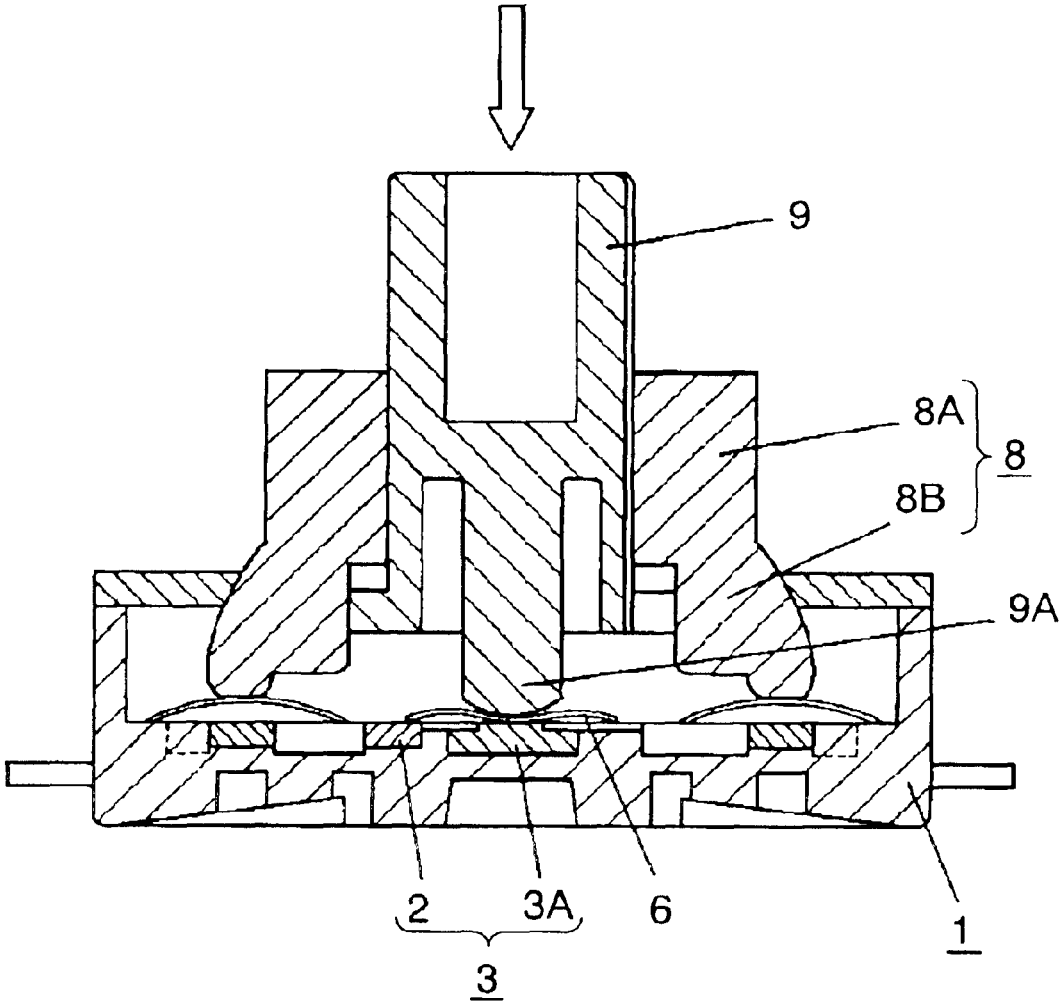
FIG. 15 PRIOR ART
FIG. 15 is a sectional front view showing a state where the stick of the conventional four-directional control switch is pressed for operation.

Furthermore, protrusion 41 can be formed at a center of an inner bottom of case 21, and hollow 41 corresponding to protrusion 41 can be formed at a center of a bottom of controlling unit 35, as shown in FIG. 10. Using this structure, controlling unit 35 can be held by protrusion 41. In addition, hemispherical convex section 43 can be formed at a center of an inner bottom of case 21, and hemispherical concave section 44 corresponding to convex section 43 can be formed at a bottom of controlling unit 35, as shown in FIG. 11.

In this embodiment, operating unit 30 having arms 32A–32D is formed by punching and bending an elastic thin metal plate. However, operating unit 30 can be formed in one piece of an elastic resin.

What is claimed is:

1. A four-directional control switch comprising:

a quadrangular switch case having first, second, third and fourth sides;

a first arm mounted to said switch case adjacent and parallel to said first side of said switch case, said first arm being at least half as long as said first side of said switch case;

a second arm mounted to said switch case adjacent and parallel to said second side of said switch case, said second arm being at least half as long as said second side of said switch case;

a third arm mounted to said switch case adjacent and parallel to said third side of said switch case, said third arm being at least half as long as said third side of said switch case;

a fourth arm mounted to said switch case adjacent and parallel to said fourth side of said switch case, said fourth arm being at least half as long as said fourth side of said switch case;

a controlling unit mounted to said switch case and including a stick, and a flange section, arranged to press and operate said arms upon tilting of said stick, formed at a lower end of said stick; and four individual switches respectively disposed at four comers of an inner bottom of said switch case and being respectively operable by said arms.

2. The four-directional control switch of claim 1, wherein said arms respectively include pressing sections which respectively confront said individual switches at positions at which said individual switches are operated.

3. The four-directional control switch of claim 1, wherein said controlling unit further includes a first protrusion formed at a center of a bottom of said flange section, said first protrusion being arranged to come into contact with a center of said inner bottom of said switch case.

4. The four-directional control switch of claim 1, wherein said controlling unit further includes four second protrusions formed at an outer periphery of said flange section and being respectively operable to press and operate said arm.

5. The four-directional control switch of claim 1, further comprising a cover having a central hole, said flange section protruding through said central hole and being tiltably held by said cover.

6. The four-directional control switch of claim 1, wherein said switch case has hollows respectively formed at four corners of said inner bottom thereof; and each of said four individual switches includes a fixed contact provided in one of said hollows, and a dome-shaped movable contact formed of an elastic thin metal plate and disposed above said fixed contact.

7. The four-directional control switch of claim 6, further comprising a pliable insulating sheet covering said hollows.

8. The four-directional control switch of claim 1, further comprising:

a central switch, which works by pressing an upper section thereof, disposed at a center of said inner bottom of said switch case; and wherein said controlling unit is mounted to be vertically movable, and said central switch works by pressing said stick vertically.

9. The four-directional control switch of claim 1 further comprising a frame; and hinge sections for respectively coupling said frame with said arms in a manner that said arms can move vertically.

10. The four-directional control switch of claim 9, wherein said arms, said hinge sections and said frame are formed in one piece of one of an elastic thin metal plate and an elastic resin.

* * * * *